US009945632B1

(12) United States Patent
Lowrance et al.

(10) Patent No.: US 9,945,632 B1
(45) Date of Patent: Apr. 17, 2018

(54) BOLT CAPTURE AND RELEASE MECHANISM AND METHOD FOR AN IMITATION MACHINE GUN

(71) Applicant: Pathfinder Systems, Inc., Arvada, CO (US)

(72) Inventors: Kyle Lowrance, Westminster, CO (US); C. Ross Cohlmia, Arvada, CO (US)

(73) Assignee: Pathfinder Systems, Inc., Lakewood, CO (US)

( * ) Notice: Subject to any disclaimer, the term of this patent is extended or adjusted under 35 U.S.C. 154(b) by 825 days.

(21) Appl. No.: 14/541,559

(22) Filed: Nov. 14, 2014

(51) Int. Cl.
*F41A 33/06* (2006.01)
*F41A 33/00* (2006.01)

(52) U.S. Cl.
CPC ..... *F41A 33/06* (2013.01); *F41A 33/00* (2013.01)

(58) Field of Classification Search
CPC ..... F41A 33/00; F41A 33/02; F41A 33/04; F41A 33/06; F41A 19/00
See application file for complete search history.

(56) References Cited

U.S. PATENT DOCUMENTS 8,746,226 B2 * 6/2014 Lee ..... F41A 33/06 124/56
9,291,420 B1 * 3/2016 Jensen ..... F41G 3/26
9,719,748 B2 * 8/2017 Monti ..... F41A 33/06

* cited by examiner

*Primary Examiner* — Timothy A Musselman
(74) *Attorney, Agent, or Firm* — Dorr, Carson & Birney, PC

(57) ABSTRACT

Electromagnetic force holds a reciprocatively movable bolt in a charged position in resistance to compressive force from a bolt actuating spring, while generating recoil impacts that simulate firing rounds of ammunition from an ammunition belt in imitation machine gun. Terminating the electromagnetic force allows the compressive force from the actuating spring to move the bolt from the charged position after simulating the firing of the last round from the ammunition belt.

15 Claims, 9 Drawing Sheets

BOLT CAPTURE AND RELEASE MECHANISM AND METHOD FOR AN IMITATION MACHINE GUN

CROSS REFERENCE TO RELATED APPLICATION

This invention is related to an invention for a Recoil Simulator and Method for an Imitation Machine Gun, described in U.S. patent application Ser. No. 14/541,515, filed concurrently herewith, now U.S. Pat. No. 9,746,273, issued on Aug. 29, 2017, and assigned to the assignee of the present invention. The subject matter of this application is incorporated herein fully by this reference.

FIELD OF THE INVENTION

This invention relates generally to training persons to operate an actual machine gun by using an imitation or simulated machine gun. More particularly, the present invention relates to a new and improved bolt capture and release mechanism and method which more reliably and fully simulates, with an imitation machine gun, the requirement to charge the bolt after loading an ammunition belt to enable firing the machine gun.

BACKGROUND OF THE INVENTION

In modern circumstances, it is difficult and expensive to train soldiers and military defense personnel in the effective use of high-powered rapid-fire machine guns, by simply allowing such individuals to practice using the actual guns with live ammunition. The ammunition rounds are expensive, for example costing up to five dollars per round. The cost of ammunition alone quickly multiplies when it is recognized that a typical machine gun is capable of firing hundreds of rounds per minute. Adequate space for a practice gunnery range may not be readily available. Increased cost is involved in transporting the personnel and the equipment to suitable remote locations where adequate gunnery practice can be performed. Safety is always a major consideration when live ammunition rounds are fired, both to military personnel involved in gunnery practice and to non-military personnel who may be adjacent to the gunnery range. It is difficult to instruct during a live ammunition training session due to the noise and safety considerations involved when others are involved in similar, close-by, live-ammunition practice activities. Furthermore, it may be difficult to vary the targets quickly at a live-ammunition gunnery range.

These problems and practical constraints are exacerbated when training individuals to shoot from a moving vehicle such as a helicopter. If live ammunition practice is attempted from a moving helicopter, a large space is required in order to maneuver the helicopter and to provide targets and adequate safety barriers, especially when multiple individuals are involved in similar simultaneous training exercises. As a result, live gun practice requires considerable space, and the cost of operating the helicopter greatly multiplies the overall training cost.

Because of these and other considerations, simulated weapon training programs have been developed for teaching purposes. Such training programs use imitation machine guns which closely simulate the sensational aspects and the mechanical and physical requirements of firing actual machine guns. Firing is simulated by reproducing effects which mirror the sensual perceptions associated with firing the actual machine gun. The environment and the targets are electronically displayed, allowing them to be more easily varied and to simulate movement of the targets and the machine gun. The trajectory of the simulated bullet fired is also calculated. In those cases where the simulated fired bullet emulates a tracer, the trajectory of that simulated bullet is also displayed in the surrounding environment.

For helicopter gun training, the imitation machine gun is mounted in an open door of an imitation portion of the helicopter fuselage. The environment and the targets are displayed outside of the open door. The portion of the imitation helicopter fuselage is moved or shaken in a manner similar to the movement of an actual helicopter in flight while the display of the surrounding environment and the targets are moved to simulate the flight path of the helicopter.

Simulated weapons training programs offer other benefits. Environments of remote areas of the world may be simulated, thereby providing training exposure to such environments prior to actually deploying the military personnel to those locales. The accuracy of the training program and the abilities of the individuals trained may be assessed. The accuracy in shooting, and the success of the training itself, is gauged by comparing the calculated, projected trajectory of the simulated bullets relative to the displayed targets. The number of simulated rounds fired may also be counted to evaluate the efficiency of the individual doing the shooting. Other factors can be evaluated from the vast amount of information available from such computer-based simulated weapons training programs.

Of course, to be effective for training purposes, it is necessary to create a realistic simulated environment and a realistic experience of firing the imitation machine gun. Such simulation is accomplished principally by multiple computer systems which are programmed to perform their specific simulation activities in coordination with each other. In the end, the capability of the simulated weapons training program to imitate the actual use of the actual machine gun in an actual environment is the ultimate measure of effective and successful training.

Individuals become accustomed to the imitation machine gun due to the amount of simulated training received. Because of the familiarity gained from training with the imitation machine gun, use of the imitation machine gun should be essentially the same as the use of the actual machine gun; otherwise, differences in functionality or performance create unexpected problems or difficulties when using the actual machine gun.

One of the important aspects of training with an imitation machine gun is to simulate the recoil of firing an actual machine gun. Recoil in an actual machine gun occurs in response to firing an ammunition round. A momentary rearward impact occurs in reaction to the forward acceleration of the bullet moving out of the barrel and in reaction to a reciprocating movement of an internal bolt of the gun. The explosive force from firing the round drives the bolt rearward against the force of a bolt actuating spring. The rearward movement of the bolt automatically ejects the spent casing, withdraws the next live round from the ammunition belt, expels a connection link which joined the withdrawn round to the next round of the ammunition belt, positions the withdrawn round on the bolt for loading and firing, and advances the ammunition belt to locate the next round to undergo similar actions after active round has been fired. Depressing the trigger enables the compressed bolt actuating spring to drive the bolt forward to load the round into a firing chamber and then fire that loaded round. The pressure from the exploded round drives the bolt rearwardly against the compression force of the bolt actuating spring. The sequence of events continues in the same manner with each subsequent pull of the trigger, or the sequence of events continues repetitively and continuously while the trigger remains depressed. Each ammunition round fired, accompanied by the reciprocating movement of the bolt in the manner described, creates a reactive impact. The individual operating the gun feels the sensation of this reaction as recoil of the machine gun. One very effective recoil simulation device, and its method of use, are described in the above-referenced US patent application.

To ready an actual machine gun for firing live ammunition rounds from a newly-loaded ammunition belt loaded, the operator must "charge" the bolt. Charging the bolt involves manually moving the bolt rearward against the force of the internal bolt actuating spring. Charging the bolt removes the first round from the ammunition belt and positions the removed round on the bolt for loading and firing. Charging the bolt enables the compressed bolt actuating spring to drive the bolt forward to load and fire the round. Thereafter, the explosion from firing that round drives the bolt rearward and compresses the bolt actuating spring to enable the continuous repetition of these actions with each subsequent pull of the trigger or on a continuous basis while the trigger remains depressed.

Loading a simulated ammunition belt in an imitation machine gun is also an important part of training to use the actual machine gun. The imitation machine gun must emulate the functionality of charging the bolt each time a new simulated ammunition belt is loaded. After simulated ammunition belt is loaded and the bolt is charged, the recoil simulator mechanism of the imitation machine gun simulates the recoil impacts generated by firing rounds and the reciprocation of the bolt. When the last round of the simulated ammunition belt is fired stimulatively, the bolt is released from its charged position. The bolt in the imitation machine gun thereafter assumes the same position that the bolt of an actual machine gun assumes after the last round of an actual ammunition belt has been fired.

One previous technique used in an imitation machine gun to simulate the action of charging the bolt involves holding the bolt in the charged position after the bolt has been manually charged by the operator. A holding pawl of the imitation machine gun pivots into contact with the bolt in the charged position to restrain the bolt against the considerable compression force from the bolt actuating spring. A spring pivots the holding pawl into position to restrain the bolt when the bolt is charged. The holding pawl is intended to restrain the bolt while the recoil simulation device generates the impacts which simulate firing the rounds from the simulated ammunition belt loaded into the imitation machine gun. A solenoid acts against the holding pawl to pivot it and release the bolt when all of the rounds of the simulated ammunition belt have been fired stimulatively. The released bolt moves forward to the position of the bolt in an actual machine gun after the last round of an actual ammunition belt has been fired. Thereafter, in both the actual and the imitation machine guns, a new ammunition belt must be loaded and the bolt must be charged before firing can commence again.

Often, the frictional forces acting on the holding pawl from the bolt and the forces from the pawl holding spring are too much for the solenoid to overcome and release the bolt. A failure to release the bolt when all of the rounds of the simulated ammunition belt has been fired stimulatively prevents the user from executing all of the actions necessary to load another simulated ammunition belt and ready the imitation machine gun for firing. On the other hand, if the pawl holding spring is weakened enough to allow the solenoid to pivot the pawl and release the bolt, the pawl holding spring is typically not strong enough to maintain the holding pawl in the bolt restraining position under the influence of repetitive recoil impacts generated by the recoil simulation device. Under such circumstances, the bolt is released prematurely before all of the rounds of the simulated ammunition belt have been fired.

In both cases, where the bolt is not released after all of the rounds of the simulated ammunition belt have been fired stimulatively, or where the bolt is released prematurely before all the rounds of the simulated ammunition belt have been fired stimulatively, dissimilarities in the performance of the imitation machine gun compared to the actual machine gun occur. The operator of the imitation machine gun is required to perform different and unusual activities which are not involved in operating the actual machine gun. As a result, the quality of the training is compromised. Furthermore, the resulting erratic effects have the potential of adversely influencing the coordination of the computer systems which control the simulated weapons training program, because those computer systems anticipate firing the full number of simulated rounds of the simulated ammunition belt. As a result, the training experience may be disrupted.

SUMMARY OF THE INVENTION

The present invention overcomes the previous problems of holding and releasing the bolt in an imitation machine gun. The problems of failing to release the bolt after all of the rounds of the simulated ammunition belt have been fired and of prematurely releasing the bolt prior to firing the anticipated number of rounds of the simulated ammunition belt, are avoided by the present invention. In addition, the present invention diminishes the risk of loss of coordination among the control systems in the training simulator resulting from a premature or failed release of the bolt during training. As a consequence, training with an imitation machine gun which employs the present invention is more effective and realistic, and the individuals trained are more capable of properly operating the actual machine gun in actual circumstances.

In accordance with the above described and other related considerations, a bolt capture and release mechanism and method of present invention involves simulating realistically, in an imitation machine gun, the action of charging the bolt required to fire an actual machine gun after loading a new ammunition belt. The present invention also reliably retains the charged bolt under the repeated impacts generated by a recoil simulation device simulating the firing of ammunition rounds. Further still, the present invention allows realistic training of charging the bolt after simulatively firing all of the rounds of an actual ammunition belt and loading another simulated ammunition belt.

The bolt capture and release mechanism of the present invention is used in an imitation machine gun to simulate actions required to charge the bolt of an actual machine gun. The imitation machine gun has a reciprocatively movable bolt which is biased by a bolt actuating spring. The bolt requires manual movement in one direction against compression force from the actuating spring to charge the bolt and thereby enable the gun to fire simulated rounds of ammunition from a simulated ammunition belt loaded into the gun. The bolt is movable in the opposite direction from the compression force of the actuating spring after firing of the last simulated round of the ammunition belt. The gun includes a recoil simulator device which generates recoil impacts that simulate firing each simulated round from the simulated ammunition belt.

The bolt capture and release mechanism comprises an electromagnet adapted to be stationarily positioned on the imitation machine gun at a position adjacent to bolt when the bolt is manually moved to a position to charge the bolt. The electromagnet develops sufficient electromagnetic attracting force on the bolt to hold the bolt in the charged position during the recoil impacts generated by the recoil simulator device when simulating the firing rounds from the ammunition belt. The electromagnetic force is terminated to allow the compressive force from the bolt actuating spring to move the bolt in the opposite direction from the charged position when the recoil simulation device generates the last recoil impact that simulates firing the last round of an ammunition belt.

A subsidiary feature of the bolt capture and release mechanism involves an armature adapted to be attached to the bolt at a position to be adjacent to the electromagnetic when the bolt is in the charged position. The armature is formed of magnetic material which attractively interacts with the electromagnetic force from the electromagnet to hold the bolt in the charged position during the recoil impacts generated by the recoil simulator device.

Another subsidiary feature of the bolt capture and release mechanism involves a detent mechanism which is attached to the gun and interactive with the bolt to apply mechanical resistance force on the bolt in the charged position to assist in resisting the compressive force from the bolt actuating spring. The detent mechanism comprises a plunger having a contact surface which is biased into contact with an angled surface of the bolt. The compressive force of the bolt actuating spring is sufficient to overcome the mechanical resistance force from the detent when the electromagnet stops creating the electromagnetic attracting force. However, it is preferred that the electromagnetic force from the electromagnet is sufficient to hold the bolt in the charged position during the recoil impacts apart from the mechanical resistance force supplied by the detent mechanism.

The invention also involves a method of capturing a reciprocatively movable bolt in a charged position and selectively releasing the bolt, in an imitation machine gun. The method involves biasing the bolt with compressive force from a bolt actuating spring, manually moving the bolt against the compression force from the actuating spring to charge the bolt, applying electromagnetic force on the bolt to hold the bolt in the charged position while generating recoil impacts that simulate firing rounds of simulated ammunition from an ammunition belt, and terminating the electromagnetic force on the bolt and allowing the compressive force from the actuating spring to move the bolt in the opposite direction from the charged position after simulating the firing the last round from the ammunition belt.

Subsidiary features of the method involve some or all of the following: attaching an armature to the bolt and attracting the armature with the electromagnetic force to hold the bolt in the charged position during the recoil impacts generated by the recoil simulator device; applying mechanical resistance force on the bolt in the charged position in addition to the electromagnetic force to resist the compressive force from the actuating spring; overcoming the mechanical resistance force with compressive force from the actuating spring upon terminating the electromagnetic force to move the bolt in the opposite direction from the charged position; and enabling the generation of recoil impacts by manually moving the bolt to the charged position.

Other aspects and features of the invention, and a more complete appreciation of the present invention, as well as the manner in which the present invention achieves the above and other improvements and benefits, can be obtained by reference to the following detailed description of a presently preferred embodiment of the invention taken in connection with the accompanying drawings which are briefly summarized below, and by reference to the appended claims.

DETAILED DESCRIPTION

Figure 1:
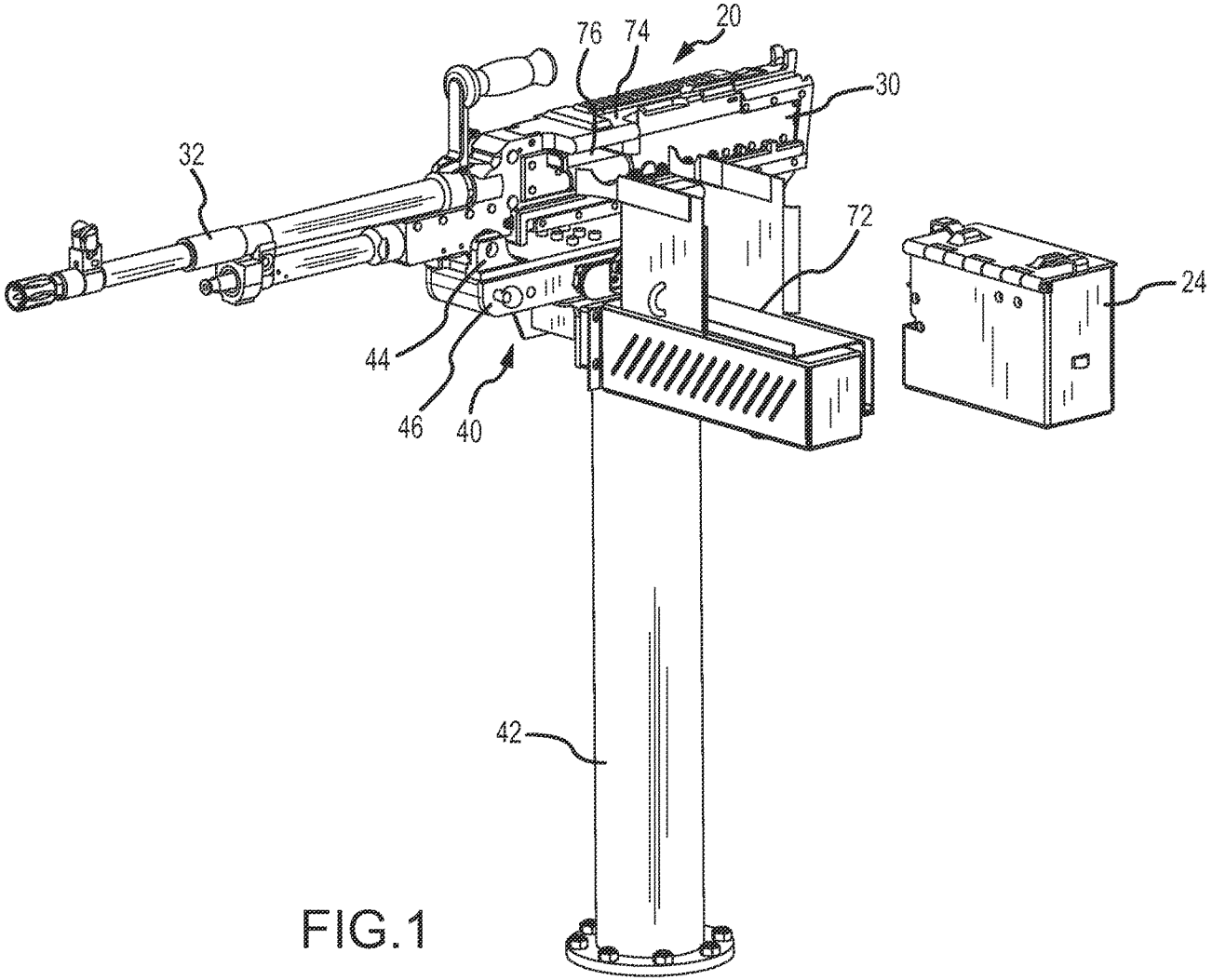
FIG. 1 is a generalized perspective view of an exemplary imitation machine gun which incorporates and embodies a bolt capture and release mechanism and method according to the present invention.
Figure 2:
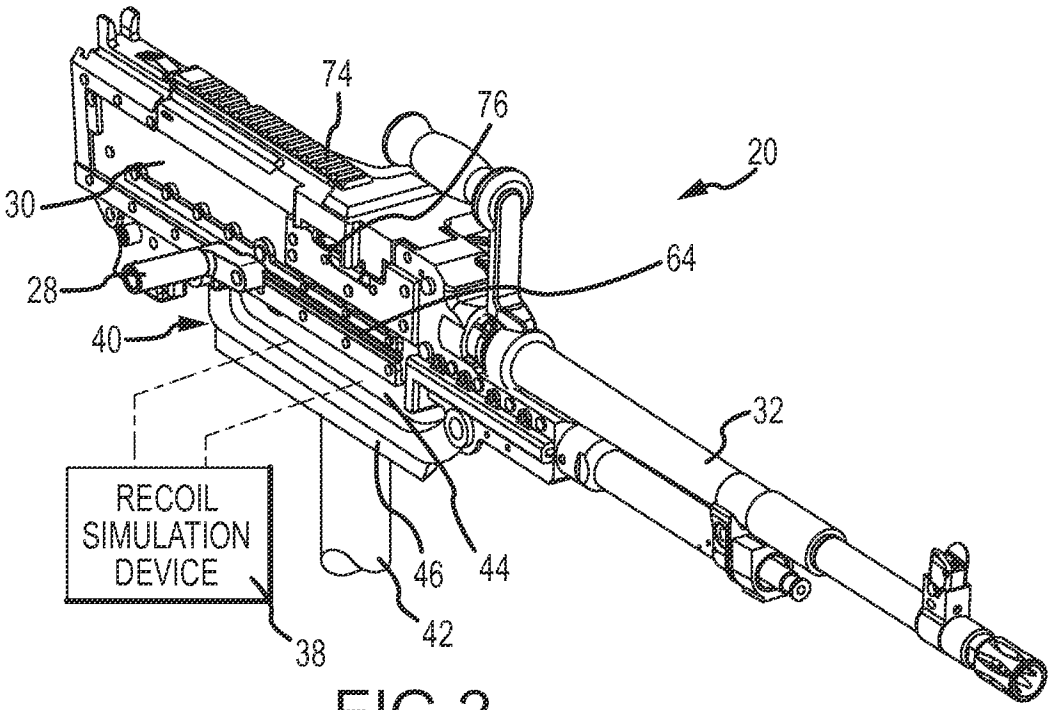
FIG. 2 is a perspective view of the imitation machine gun shown in FIG. 1, taken from the perspective on the opposite side of the imitation machine gun from that shown in FIG. 1, illustrating a charging handle used in charging the bolt, with the charging handle in the position occupied when the bolt has been charged.
Figure 3:
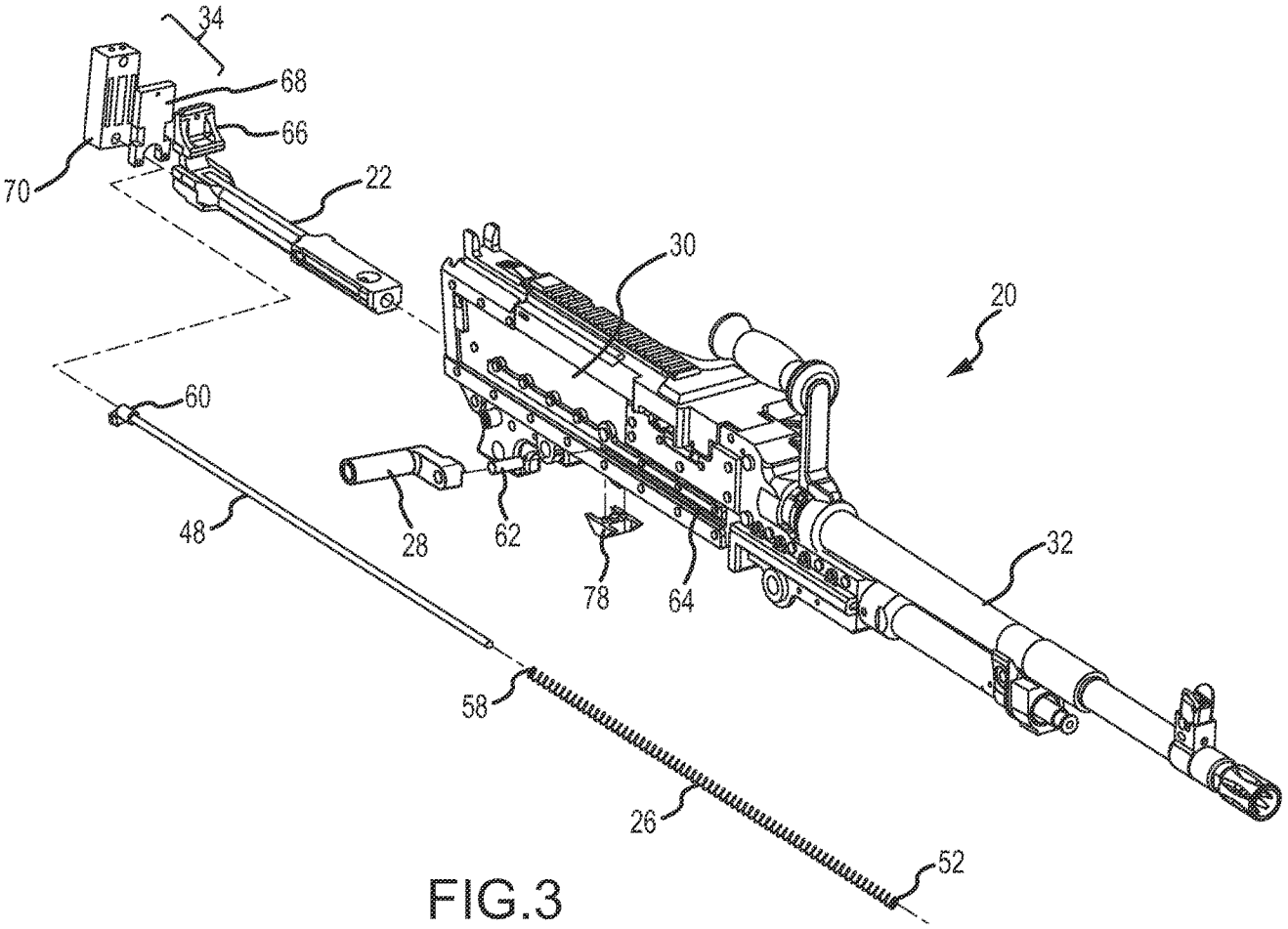
FIG. 3 is a partial exploded and perspective view of the imitation machine gun shown in FIG. 2, illustrating the charging handle, the bolt and components of the bolt capture and release mechanism and a detent mechanism in an exploded relationship relative to the gun.
Figure 4:
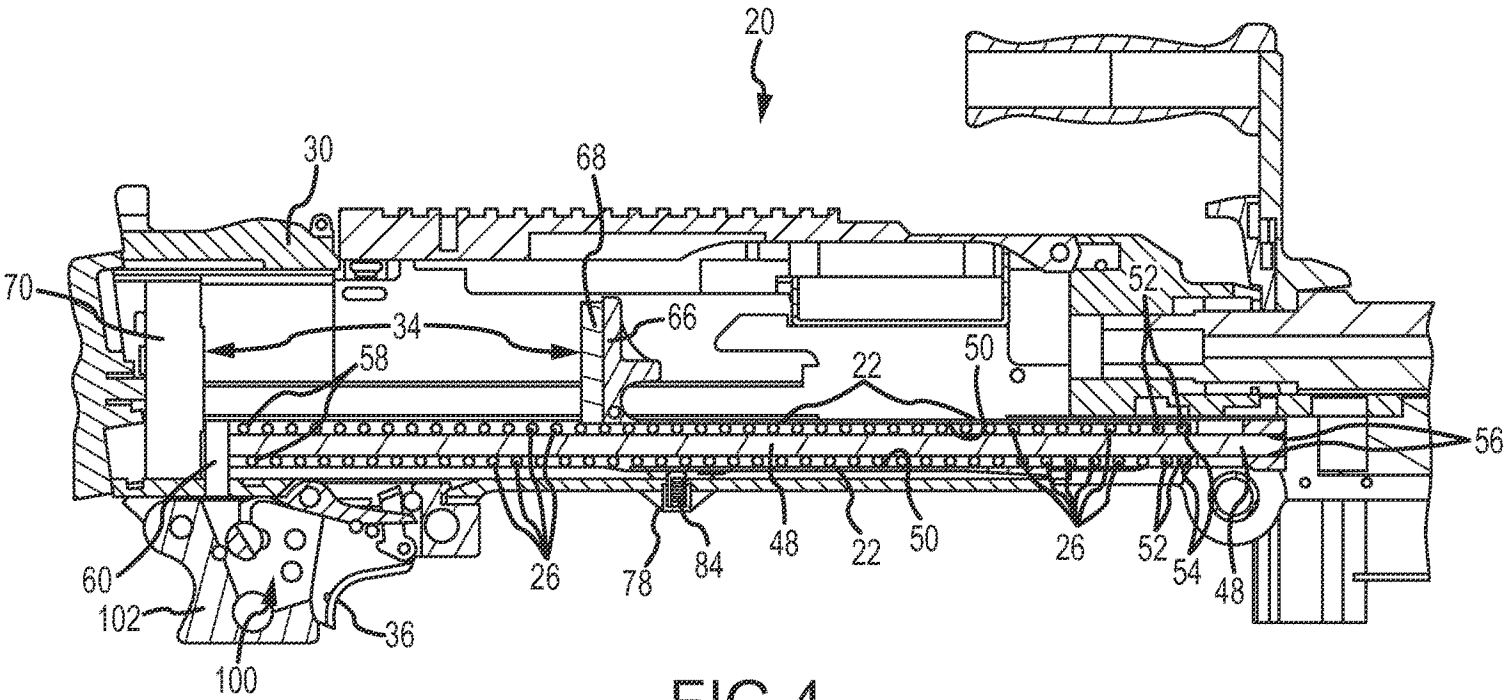
FIG. 4 is a vertical section view taken through a housing of the imitation machine gun shown in FIG. 2, illustrating the bolt in a forward position from which the bolt must be charged.
Figure 5:
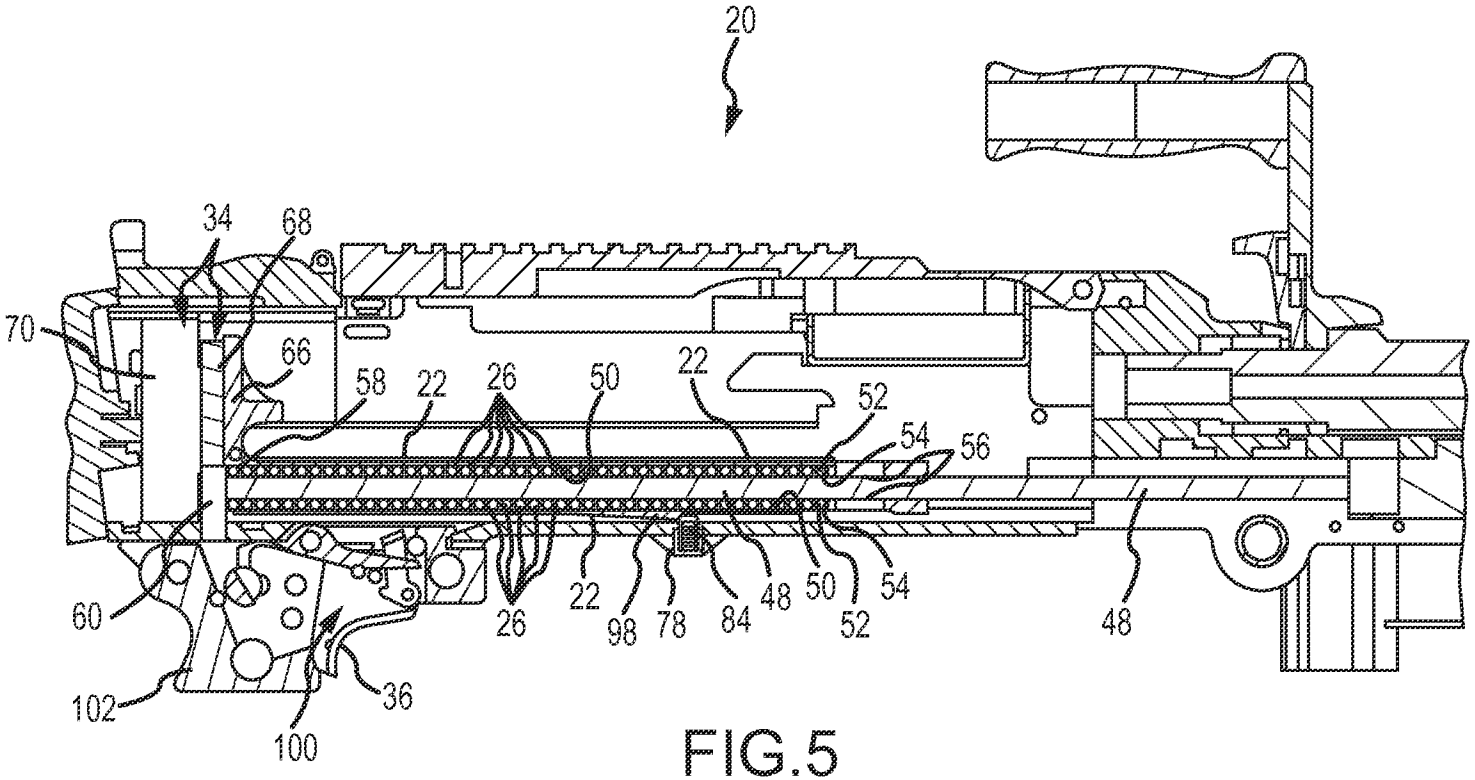
FIG. 5 is a view similar to FIG. 4, illustrating the bolt in a rearward position after the bolt has been charged.

An imitation machine gun 20 which is used in simulated weapons training activities is shown in FIGS. 1 and 2. The machine gun 20 duplicates the look and feel and the mechanical features of an actual machine gun. The machine gun 20 includes a bolt 22 (FIGS. 3-5) which must be charged to start firing ammunition rounds from a simulated ammunition belt (not shown) taken from an ammunition box 24 (FIG. 1). Charging the bolt 22 involves manually moving the bolt 22 rearward against the force of a bolt actuating spring 26 (FIGS. 3-5). In an actual machine gun, charging the bolt removes a live ammunition round from the ammunition belt and moves the live ammunition round into position on the bolt 22 for loading and firing when the trigger is pulled. Pulling the trigger allows the actuating spring 26 to drive the ammunition round into the chamber and fire it.

Charging the bolt is accomplished by pulling a charging handle 28 rearwardly, as shown in FIGS. 2 and 3. The charging handle 28 is connected to the bolt 22 and is located at the exterior of a housing 30 of the gun 20. A barrel 32 of the gun 20 extends forward from the housing 30. FIG. 4 illustrates the position of the bolt 22 prior to charging, and FIGS. 2 and 5 illustrate the position of the charging handle 28 and the bolt 22 after charging. In an actual machine gun, the bolt is charged automatically from explosive force from firing an ammunition round. The compression force from the actuating spring drives the bolt forward to load the ammunition round and fire it when a trigger of the gun is depressed or pulled. Reciprocation of the bolt occurs continuously while the trigger remains depressed.

Unlike an actual machine gun, the imitation machine gun 20 does not reciprocate the bolt 22 to simulate firing ammunition rounds. Instead, once the bolt is charged by the physical rearward movement imparted from the charging handle 28, a bolt capture and release mechanism 34 (FIGS. 3-5) holds the bolt 22 in the rearward position, despite the fact that a trigger 36 (FIGS. 4 and 5) is depressed. A recoil simulation device 38 (FIG. 2) simulates firing each ammunition round by shaking or reciprocating the machine gun 20 in a forward and backward motion to simulate the recoil impact of firing each live ammunition round with an actual machine gun. After all of the rounds of the ammunition belt have simulatively fired as replicated by recoil impacts generated by the recoil simulation device 38, the bolt capture and release mechanism 34 releases the bolt 22. The actuating spring 26 moves the bolt 22 forward to the position (FIG. 4) where a new simulated ammunition belt can be loaded and the bolt can thereafter be charged (FIG. 5) to initiate firing the simulated rounds from the newly-loaded ammunition belt. The bolt capture and release mechanism 34 is particularly effective in holding the bolt under the adverse vibrations generated by the recoil simulation device 38.

To perform the recoil simulation, the machine gun 20 is supported by a split cradle assembly 40 which mounts the gun 20 to a support pedestal 42, as shown in FIGS. 1 and 2. The support pedestal 42 is attached to a floor or other support structure which emulates the actual environment in which the actual machine gun will be used, for example an opening in the side of a helicopter fuselage. The split cradle assembly 40 is formed by an upper movable cradle piece 44 and a separate lower stationary cradle piece 46. The gun 20 is rigidly attached to the movable piece 44, and the stationary piece 46 is rigidly attached to the pedestal 42. The recoil simulation device 38 is operatively connected to create relative movement between the cradle pieces 44 and 46, thereby simulating recoil associated with firing an actual machine gun. An example of a recoil simulation device 38 is described in the above-referenced US patent application. An actual machine gun is supported by a integral cradle assembly formed as a single unitary piece.

Figure 8:
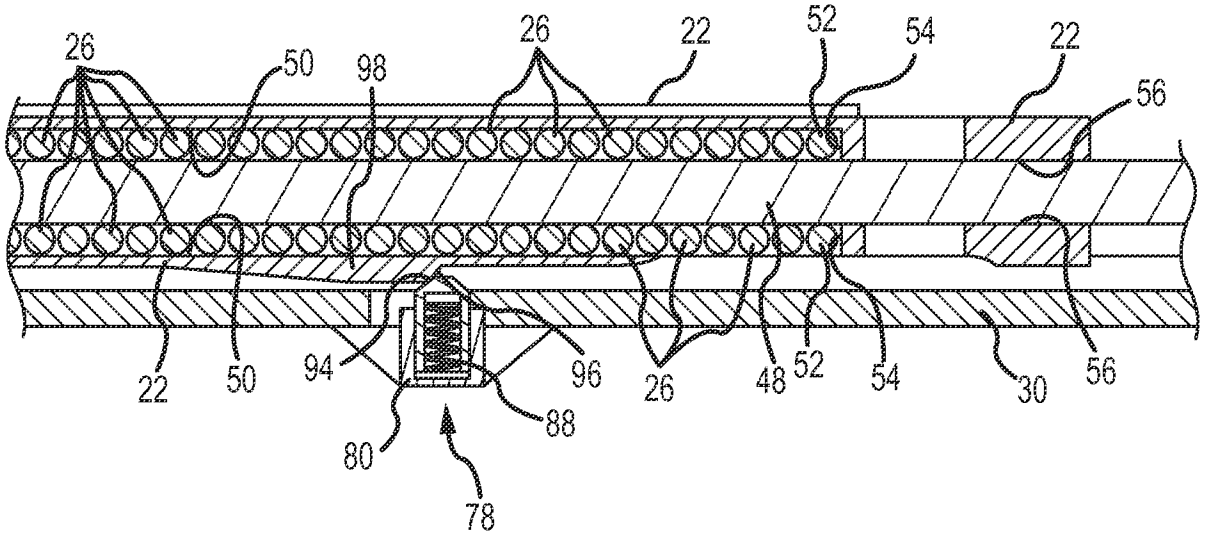
FIGS. 8 and 9 are enlarged views of portions of FIG. 5.

The bolt 22 with which the capture and release mechanism 34 interacts, is substantially similar in size, shape and inertial momentum to an actual bolt of an actual machine gun. The bolt 22 is supported for movement by rails (not specifically shown) within the housing 30, shown in FIGS. 3-5. The bolt 22 moves along a guide rod 48 which extends longitudinally within the housing 30 and parallel to the barrel 32. The bolt actuating spring 26 surrounds the guide rod 48. The bolt actuating spring 26 and the guide rod 48 extend within an annular opening 50 which is formed longitudinally within the bolt 22. A front end 52 of the actuating spring 26 contacts a front end wall 54 of the annular opening 50 in the bolt 22, as is also shown in FIG. 8. The front end wall 54 is formed by a radially inward stepped portion of the bolt 22 adjacent to a reduced-diameter opening 56 in the bolt 22. The reduced diameter opening 56 constitutes a bearing for the bolt 22 when it reciprocates along the guide rod 48. A rear end 58 of the actuating spring 26 contacts a rear connector 60 which is attached to the rear end of the guide rod 48. The rear connector 60 is also attached rigidly to the floor of the housing 30. In this manner, the bolt actuating spring 26 surrounds the guide rod 48, and the front and rear ends 52 and 58 of the bolt actuating spring contact the end wall 54 and the connector structure 60, respectively.

When the bolt 22 is charged as shown in FIG. 5, the end wall 54 of the annular opening 50 moves toward the rear connector 60, thereby compressing the bolt actuating spring 26 between its ends 52 and 58. The force of the compressed actuating spring 26 is effectively applied between the bolt 22 at the end wall 54 of the annular opening 50 and the housing 30 at its bottom floor. The force from the compressed spring 26 is substantial, for example between 50 and 300 pounds. The compression force replicates the force of the bolt actuating spring of an actual machine gun. The forward driving force of the compressed bolt actuating spring of the actual machine gun must be substantial because that compression force is instrumental in determining a quick repetitive firing capability of the actual machine gun. Replicating the force required to charge the bolt in an actual machine gun is important in creating effective training with the imitation machine gun 20, to enable an operator to become familiar with the level of physical effort required to actually charge the bolt of the actual machine gun. When the bolt 22 is released, the compression force from the actuating spring 26 drives the bolt 22 forward to the position shown in FIG. 4.

The charging handle 28 is connected to the side of the bolt 22, as understood from FIGS. 2 and 3. A shaft 62 connects the charging handle 28 and the bolt 22. The shaft 62 moves along a slot 64 formed in the side of the housing 30. Charging the bolt is accomplished by pulling rearwardly on the charging handle 28 on the exterior of the housing 24. Charging the bolt moves the bolt 22 to the rearward position within the housing 30, as shown in FIG. 5.

More details of the bolt capture and release mechanism 34 are understood by reference to FIGS. 3-5. A rear end of the bolt 22 includes an upstanding transverse bracket 66. An armature 68 is rigidly attached to the rear end of the bracket 66. The armature 68 is formed of a non-magnetized and impact resistant ferrous material, such as cold-rolled and nickel plated steel. An electromagnet 70 is located at a rear position within the housing 24. Charging the bolt by pulling the charging handle 28 to move the bolt 22 rearwardly positions the armature 68 in close adjacency to or in contact with the electromagnet 70 (FIG. 5). The electromagnet 70 is formed in the typical manner to include coils of a current carrying conductor (not specifically shown). The electromagnet 70 creates a magnetic field which attracts the armature 68 and holds the bolt 22 in the rearward position of the bolt when charged. The number of coils in the electromagnet 70 and the amount of current conducted by the conductor of the electromagnet 70 establish the strength of the magnetic field, and consequently the strength of the holding force on the bolt 22. The amount of holding force created by the electromagnet 70 is substantial enough to reliably hold the bolt 22 in the charged position against the substantial force from the compressed bolt actuating spring 26, even under the conditions of vigorous vibrations and shaking created by the recoil simulation device 38 when simulating the firing of ammunition rounds.

So long as adequate electrical current is applied to the electromagnet 70, the magnetic attracting force between the electromagnet 70 and the armature 68 retains the bolt 22 in the rearward charged position. The electromagnet 70 retains the bolt 22 in the charged position while simulating the firing of all of the ammunition rounds of an actual ammunition belt. Once all of the simulated rounds of the ammunition belt have been fired, the flow of electrical current to the electromagnet 70 is terminated. The magnetic attracting force between the electromagnet 70 and the armature 68 ceases, and the bolt 22 moves forward under the force of the compressed bolt actuating spring 26. The forward movement of the bolt 22 simulates the movement of the bolt in the actual machine gun after the last live ammunition round of the actual ammunition belt has been fired and no further live ammunition rounds are available from the ammunition belt.

In order to continue firing the imitation machine gun 20, as understood from FIGS. 1 and 2, the operator must replace the ammunition box 24 with a new ammunition box, and load a new simulated ammunition belt (not shown) from that box 24 into the imitation machine gun 20. Loading the simulated ammunition belt is accomplished by removing the used ammunition box 24 from a support tray 72 which extends transversely from the housing 30 on the opposite side of the charging handle 28, placing a new ammunition box onto the support tray 72, opening a top cover 74 of the housing 30 to gain access to an ammunition belt feedway 76 formed in the housing 30, opening the top cover of the ammunition box 24, withdrawing the simulated ammunition belt from the box 24, placing simulated ammunition belt in the feedway 76, and closing the top cover 72 over the simulated ammunition belt. The ammunition box 24 is actual size, but the simulated ammunition belt within the box 24 is only of a limited length necessary to extend from the opened box 24 into the belt feedway 76. To load the simulated ammunition belt in this manner, the bolt 22 must be located in the forward position (FIG. 4).

Figure 6:
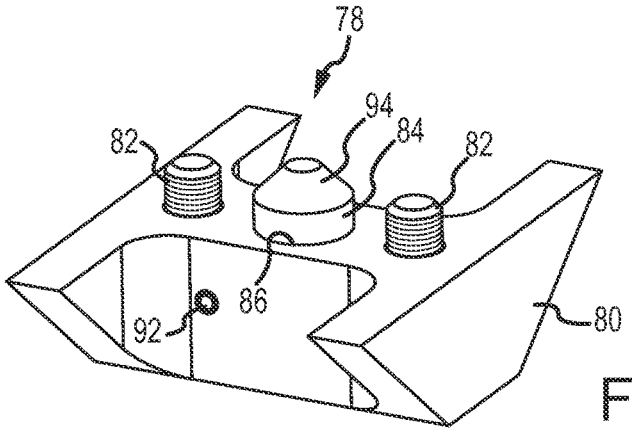
FIG. 6 is a perspective view of the detent mechanism of the bolt capture and release mechanism shown in FIGS. 3-5.
Figure 7:
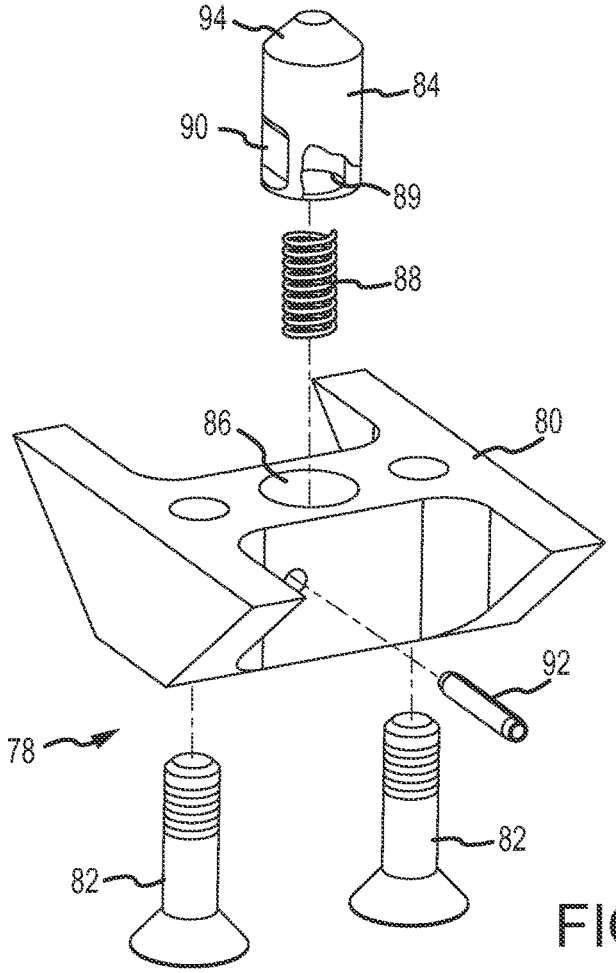
FIG. 7 is an exploded perspective view of the components of the detent mechanism shown in FIG. 6.

A detent mechanism 78 of the bolt capture and release mechanism 34 is shown in FIGS. 3, 6 and 7 and is used to assist the electromagnet 70 in holding the bolt 22 in the rearward position against the compression force of the bolt actuating spring 26. A body 80 of the detent mechanism 78 is attached by bolts 82 to the bottom floor of the housing 30. A plunger 84 is positioned within a vertical annular opening 86 in the body 80. The plunger 84 is biased upward from the annular opening 86 by a spring 88. The spring 88 is located within the annular opening 86 in the body 80 and in an annular recess 89 in the plunger 84. The spring 88 is compressed between the plunger 84 and the body 80. A flat surface 90 is formed in the side wall of the plunger 84, and a pin 92 extends transversely across an edge of the annular opening 86 adjacent to the flat surface 90. The pin 92, which extends through the body 80, interacts with the flat surface 90 and retains the plunger 84 for movement within the annular opening 86. The axial extent of the flat surface 90 along the side of the plunger 84 also controls the degree to which the plunger will move in the annular opening 86 relative to the body 80.

A frustroconical shaped contact surface 94 is formed on the upper end of the plunger 84 which protrudes out of the body 80. The contact surface 94 interacts with an angled surface 96 of a downward facing middle ridge 98 formed on the bottom center of the bolt 22, as shown in FIGS. 5 and 8. When the bolt 22 has been charged and is in the rearward position, the contact surface 94 of the plunger 84 contacts the angled surface 96 of the ridge 98, as shown in FIG. 8.

The resistance created by the interaction and contact between angled surface 96 of the ridge 98 and the contact surface 94 of the plunger 84 when biased upwardly by the compressed spring 26, creates resistance to forward movement of the bolt 22. The amount of resistance created by the detent mechanism 78 assists the electromagnet 70 in holding the bolt 22 in the rearward position (FIG. 5) under the influence of the compressed bolt actuating spring 26. However, when the attracting force from the electromagnet 70 ceases, the resistance from the detent mechanism 78 is insufficient by itself to prevent the compressed bolt actuating spring 26 from moving the bolt 22 forward (FIG. 4). The compressed actuating spring 26 forces the angled surface 96 forward along the contact surface 94 and pushes the plunger 84 downward into the body 80. In this manner, the detent mechanism 78 assists the electromagnet 70 in holding the bolt 22 in the charged position, but does not restrict forward movement of the bolt 22 when the electromagnetic attracting force from the electromagnet 70 on the armature 68 ceases.

The detent mechanism 78 allows the size of the electromagnet 70 to be reduced compared to the size of the electromagnet 70 required to hold the bolt 22 in the charged position by itself without the assistance of the detent mechanism 78. However the bolt capture and release mechanism 34 of the present invention also contemplates use of a sufficiently sized electromagnet 70 which generates sufficient electromagnetic force to hold the bolt in the charged position without use of the detent mechanism 78.

Figure 9:
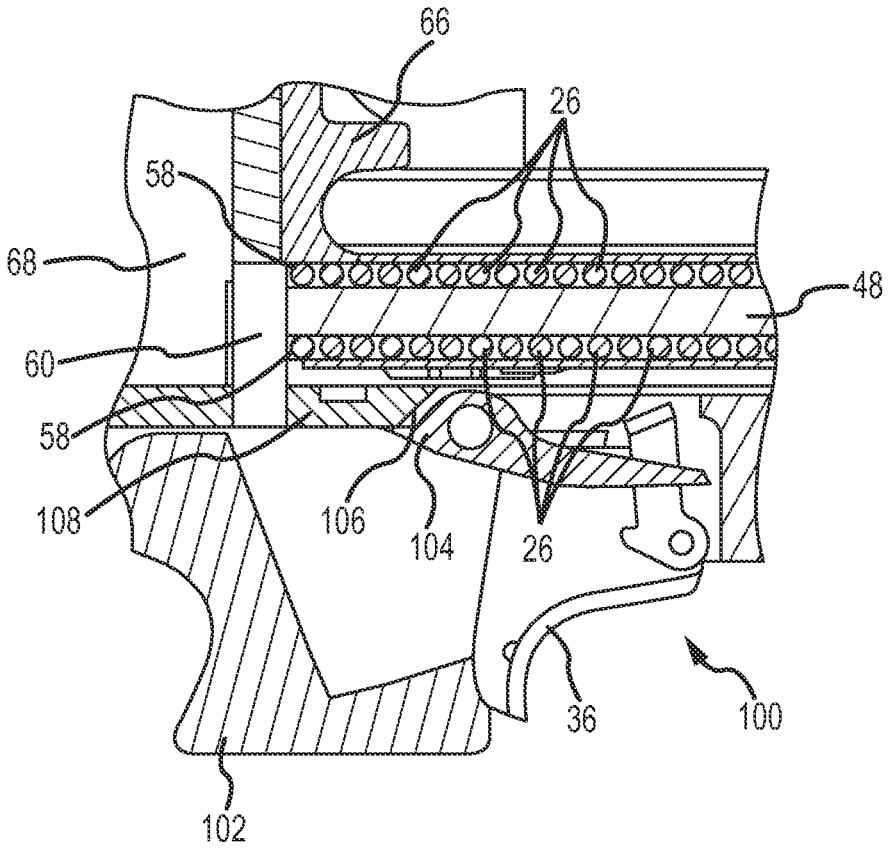

A trigger mechanism 100 of the imitation machine gun 20 is of the same construction as the trigger mechanism of an actual machine gun, as shown in FIGS. 4, 5 and 9. The trigger mechanism 100 is located in a handle 102 which is gripped by the operator when firing the gun. The trigger 36 is part of the trigger mechanism 100, and the trigger 36 extends from the front surface of the handle 102 to be squeezed by a finger of the operator. The trigger 36 is interconnected with a pawl 104, and the pawl 104 interacts with a notch 106 formed in a lower rear ridge 108 of the bolt 22 located at a rear end of the bolt 22. When the trigger 36 is not depressed, the pawl 104 extends upwardly into the notch 106 and prevents the bolt 22 from moving forward. Preventing the bolt 22 from moving forward prevents firing of the machine gun. When the trigger 36 is depressed, the pawl 104 is withdrawn from the notch 106, and the bolt 22 is free to move forward under the influence of the bolt actuating spring 26, and thereby fire the actual machine gun. So long as the trigger 36 is depressed, the pawl 104 does not prevent the automatic, continuous reciprocating action of the bolt while firing the actual machine gun.

In the imitation machine gun 20, the bolt 22 does not move forward during simulated firing. Instead, depressing the trigger 36 and holding it in a depressed condition causes the recoil simulation device 38 (FIG. 2) to reciprocate the imitation machine gun 20 in a manner which simulates firing ammunition rounds. An electrical switch (not shown) is connected to the trigger 36 to derive a control signal for activating the recoil simulation device 38. The electromagnet 70 holds the bolt 22 in the rearward charged position (FIG. 5) while the recoil simulation device replicates firing the rounds of ammunition belt.

Each individual recoil impact from of the recoil simulation device 38 is sensed and counted to determine the number of simulated rounds fired. Once the number of simulated rounds of an actual ammunition belt have been counted as fired, the recoil simulation device stops generating recoil impacts and the energizing current to the electromagnet 70 is terminated, allowing the bolt 22 to move forward to the position where another simulated ammunition belt must be loaded to continue use of the imitation machine gun 20.

Figure 10:
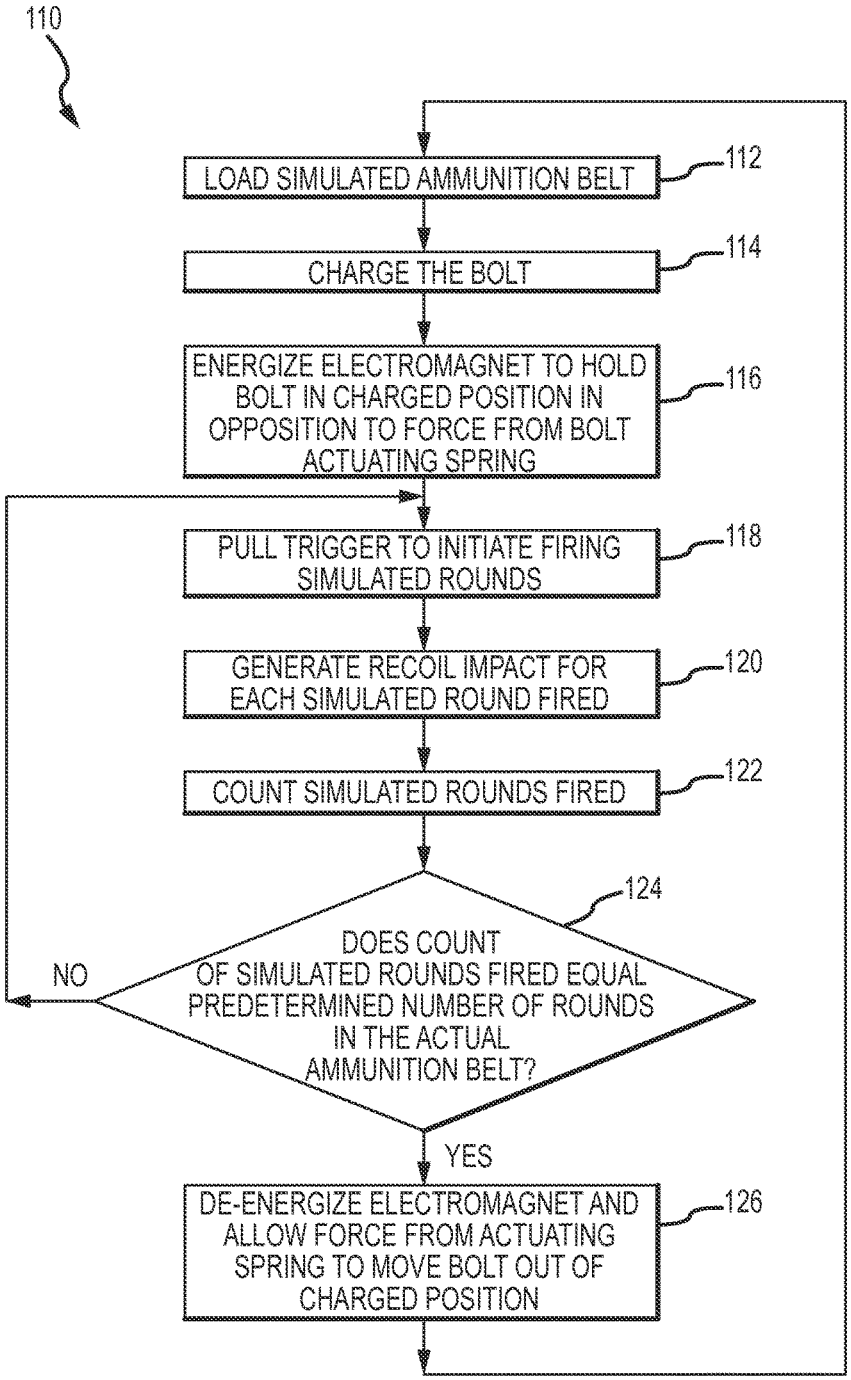
FIG. 10 is a flowchart of a sequence of actions performed by a user and by bolt capture and release mechanism when using the imitation machine gun shown in FIGS. 1-9.

A sequence 110 of actions which summarize the previously described use and functions of the bolt capture and release mechanism 34 in the imitation machine gun 20 is shown in FIG. 10. The sequence 110 begins when the simulated ammunition belt is loaded into the gun 20, as shown at 112. The simulated ammunition belt represents the predetermined number of rounds of an actual ammunition belt which will be fired by the imitation machine gun. Loading the simulated ammunition belt at 112 enables the operator to charge the bolt 22 at 114, by pulling the charging handle 28 rearward against the compressive force of the bolt actuating spring 26 (FIGS. 2 and 5). The pawl 104 of the trigger mechanism 100 (FIG. 9) holds the bolt 22 in the charged position (FIG. 5). The electromagnet 70 is then energized, at 116, by conducting current through the electrical conductors of the electromagnet. The electromagnet 70 generates sufficient electromagnetic attracting force which interacts with the armature 68 attached to the bolt 22 (FIG. 5) to hold the bolt 22 in the charged position. The electromagnet 70 holds the bolt 22 in the charged position when the trigger 36 (FIGS. 4, 5 and 9) is pulled, at 118. Pulling the trigger activates the recoil simulator device 38 (FIG. 2) to generate a recoil impact for each simulated round of ammunition fired while the trigger is depressed, as shown at 120. The number of simulated rounds fired is counted at 122. Because the number of rounds of an actual ammunition belt is known, the count at 122 of fired simulated ammunition rounds is compared to the number of known rounds in the actual ammunition belt at 124. So long as the number counted at 122 of simulated ammunition rounds fired is less than the predetermined number of rounds of the actual ammunition belt, the process reverts to 118, where continued depression of the trigger results in firing more simulated rounds at 120 and counting them at 122. Whenever the number of counted rounds at 122 equals the predetermined number of rounds of the actual ammunition belt, as determined at 124, the electromagnet 70 is de-energized at 126. De-energizing the electromagnet at 126 allows the bolt 22 to move forward in response to the compressive force from the actuating spring 26 (FIG. 4). The bolt 22 then occupies the same position (FIG. 4) as it would occupy in the actual machine gun after the last round from an actual ammunition belt has been fired. The operator is thereafter required to load a new simulated ammunition belt to enable further use of the gun 20, as shown by the process 110 reverting back to that action at 112. The same process 110 thereafter continues with the newly loaded and each subsequently newly loaded simulated ammunition belt.

The bolt capture and release mechanism 34 is capable of long-term, intensive, reliable use without premature or unexpected failure, thereby facilitating the effectiveness of training with the imitation machine gun. The bolt capture and release mechanism 34 overcomes the unreliable operation of the prior art solenoid actuated mechanism for holding the bolt in the charged position, avoids failing to release the bolt after all of the rounds of the simulated ammunition belt have been fired stimulatively, avoids the premature release of the bolt prior to firing the anticipated number of simulated rounds from the simulated ammunition belt, and avoids a loss of coordination among the control systems in the training simulator resulting from a failed, premature and/or erratic release of the bolt during training. As a consequence, the training with the imitation machine gun is more effective and realistic, and the individuals trained are more capable of properly operating the actual machine gun in actual circumstances.

The bolt capture and release mechanism 34 is concealed and functional within the imitation machine gun in a way which does not create significant differences in functionality, performance, look and feel of the imitation machine gun relative to the actual machine gun. No external additional parts appear on the imitation machine gun to otherwise create subtle differences between the imitation and actual machine guns, unlike the prior art solenoid actuated pawl which is an added piece of equipment attached to the outside of the machine gun housing. The imitation machine gun achieves and maintains substantially the same functionality, performance and physical feel of the actual machine gun. Other advantages and improvements will become apparent upon gaining a full appreciation of the present invention.

The above description is a description of a preferred example of implementing the invention. The detail of this description is not intended to limit the scope of the invention except to the extent explicitly incorporated in the following claims. The scope of the invention is defined by the following claims.

The invention claimed is:

1. A bolt capture and release mechanism for an imitation machine gun, the imitation machine gun having a reciprocatively movable bolt which is biased by an actuating spring, the bolt requiring manual movement in one direction against compression force from the actuating spring to charge the bolt and thereby enable the gun to fire simulated ammunition rounds from a simulated ammunition belt loaded into the gun, and the bolt moving in the opposite direction from the compression force of the actuating spring after firing of the last simulated round, the imitation machine gun also including a recoil simulator device which generates a recoil impact that simulates firing each simulated round, the bolt capture and release mechanism comprising:

an electromagnet adapted to be stationarily positioned on the imitation machine gun at a position adjacent to bolt when the bolt is manually moved to a position to charge the bolt, the electromagnet developing electromagnetic attracting force on the bolt to hold the bolt in the charged position during the recoil impacts generated by the recoil simulator device when simulating firing each round of ammunition of the ammunition belt, and the electromagnet terminating the attracting force to allow the compressive force from the actuating spring to drive the bolt in the opposite direction from the charged position after the last recoil impact generated by recoil simulator device which simulates firing the last round of ammunition of the ammunition belt.

2. A bolt capture and release mechanism as defined in claim 1, further comprising:

an armature adapted to be attached to the bolt at a position to be adjacent to the electromagnet when the bolt is in the charged position, the armature formed of non-magnetizing ferrous material which attractively interacts with the electromagnetic attracting force from the electromagnet to hold the bolt in the charged position during the recoil impacts generated by the recoil simulator device, the non-magnetizing ferrous material of the armature ceasing the attracting interaction with the electromagnet upon termination of the electromagnetic attracting force from the electromagnet.

3. A bolt capture and release mechanism as defined in claim 2, further comprising:

a detent mechanism attached to the imitation machine gun and interactive with the bolt to apply mechanical resistance force on the bolt in the charged position to resist the compressive force from the actuating spring.

4. A bolt capture and release mechanism as defined in claim 3, wherein:

the bolt defines an angled surface;

the detent mechanism comprises a plunger having a contact surface which is biased into contact with the angled surface of the bolt to create the mechanical resistance force; and the compressive force of the actuating spring is sufficient to overcome the mechanical resistance force on the bolt from the detent mechanism when the electromagnet terminates the electromagnetic attracting force.

5. A bolt capture and release mechanism as defined in claim 3, wherein:

the electromagnetic force from the electromagnet is sufficient to hold the bolt in the charged position during recoil impacts generated by the recoil simulation device without the mechanical resistance force on the bolt supplied by the detent mechanism.

6. A method of capturing a reciprocatively movable bolt of an imitation machine gun in a position representative of charging the bolt and then releasing the bolt from the charged position after simulatively firing rounds of an ammunition belt, comprising:

biasing the bolt with compressive force from a bolt actuating spring;

manually moving the bolt against the compression force from the actuating spring to charge the bolt;

applying electromagnetic attracting force to hold the bolt in the charged position while generating recoil impacts in the imitation machine gun that simulate firing each round of simulated ammunition; and terminating the electromagnetic attracting force and allowing the compressive force from the actuating spring to move the bolt in the opposite direction from the charged position after generating the last recoil impact which simulates firing the last round from the ammunition belt.

7. A method as defined in claim 6, further comprising:

attaching an armature to the bolt;

interacting the armature with the electromagnetic attracting force to hold the bolt in the charged position while generating the recoil impacts.

8. A method as defined in claim 7, further comprising:

applying mechanical resistance force on the bolt in the charged position in addition to the electromagnetic attracting force to resist the compressive force from the actuating spring.

9. A method as defined in claim 8, further comprising:

applying the mechanical resistance force from a detent mechanism which is attached to the imitation machine gun and which interacts with the bolt.

10. A method as defined in claim 9, further comprising:

contacting a contact surface of a plunger of the detent mechanism with an angled surface of the bolt to create the mechanical resistance force.

11. A method as defined in claim 10, further comprising:

biasing the contact surface of the plunger into contact with the angled surface of the ridge to create the mechanical resistance force.

12. A method as defined in claim 11, further comprising:

overcoming the mechanical resistance force on the bolt with the compressive force from the actuating spring upon terminating the electromagnetic attracting force to move the bolt in the opposite direction from the charged position.

13. A method as defined in claim 8, further comprising:

creating sufficient electromagnetic attracting force on the bolt to hold the bolt in the charged position during recoil impacts generated without assistance from the mechanical resistance force on the bolt.

14. A method as defined in claim 13, further comprising:

overcoming the mechanical resistance force on the bolt with the compressive force from the actuating spring upon terminating the electromagnetic attracting force to move the bolt in the opposite direction from the charged position.

15. A method as defined in claim 6, wherein:

enabling the generation of recoil impacts by manually moving the bolt to the charged position.

* * * * *